US005221081A

United States Patent [19]

Rooks

[11] Patent Number: 5,221,081

[45] Date of Patent: Jun. 22, 1993

[54] BATTING TRAINER APPARATUS

[76] Inventor: Charles W. Rooks, Rt. 1, Box 151, Kelly, N.C. 28448

[21] Appl. No.: 826,080

[22] Filed: Jan. 27, 1992

[51] Int. Cl.[5] ..... A63B 69/40

[52] U.S. Cl. ..... 273/26 R; 124/7; 124/16; 124/37; 273/260

[58] Field of Search ..... 273/26 D, 29 A, 26 R; 124/7, 37, 41 R, 16, 17, 36, 10; D21/2

[56] References Cited

U.S. PATENT DOCUMENTS

| | | | |
|---|---|---|---|
| D. 250,316 | 11/1978 | James | D21/2 |
| 2,664,077 | 12/1953 | Moore | 124/16 |
| 3,139,700 | 7/1964 | Wyrick | 124/36 |
| 3,545,752 | 12/1970 | Hill | 273/26 R |
| 3,612,027 | 10/1971 | Makino | 273/26 R |
| 3,627,319 | 12/1971 | Skyhawk | 273/26 R |
| 3,770,272 | 11/1973 | Oliver | 124/16 |
| 3,856,300 | 12/1974 | Payne | 273/26 R |
| 4,865,318 | 9/1989 | Lenhann | 273/26 R |
| 5,011,144 | 4/1991 | Marello | 273/26 R |

*Primary Examiner*—Theatrice Brown
*Attorney, Agent, or Firm*—Leon Gilden

[57] ABSTRACT

A mounting plate includes a plurality of support cylinders mounted orthogonally to the mounting plate, wherein each support cylinder is arranged to receive a baseball at its upper end. Each cylinder is of a tubular construction to accommodate the baseball sphere and each cylinder including a coil spring mounted therewithin, with each coil spring including a plurality of spring rods fixedly mounted to adjacent coils of the spring. One of the spring rods is arranged for receiving a hook member, a lower distal end of the hook member secured to a suction cup. The suction cup is initially adhered to the mounting plate within the lower distal end of the cylinder, and each suction cup of each support cylinder arranged for randomly releasing the spring to project the spring upwardly to project the associated baseball from the support cylinder with an axial of an individual attempting to strike. A modification of the invention includes the plate adjustably mounted relative to an underlying support in an angular orientation thereto, and further including an adjuster mechanism to alter adherence of each suction cup relative to the mounting plate.

5 Claims, 4 Drawing Sheets

BATTING TRAINER APPARATUS

BACKGROUND OF THE INVENTION

1. Field of the Invention

The field of invention relates to baseball training apparatus, and more particularly pertains to a new and improved batting trainer apparatus wherein the same is arranged to effect random release of baseballs for permitting access and inpact of an individual attempting to strike the baseballs with a baseball bat.

2. Description of the Prior Art

Baseball training apparatus of various types utilized in the prior art is availed to permit practice of individuals attempting to sharpen batting abilities. Such an apparatus is set forth in U.S. Pat. No. 4,097,044 to Miniere wherein a removable target is automatically positioned for batting practice after each blow thereto with a baseball bat.

U.S. PAT. No. 4,768,785 to Patterson sets forth a baseball practice apparatus arranged to learn a proper swing in a baseball procedure.

U.S. PAT. Nos. 3,588,104; 4,846,472; and 4,516,772 are each further examples of baseball training apparatus.

Accordingly, it may be appreciated that there continues to be a need for a new and improved batting trainer apparatus are set forth by the instant invention which addresses the problems of ease of use as well as effectiveness in construction to provide random access to one of a plurality of baseballs in a baseball batting procedure.

SUMMARY OF THE INVENTION

In view of the foregoing disadvantages inherent in the known types of baseball training apparatus now present in the prior art, the present invention provides a batting trainer apparatus wherein the same is arranged for random release of one of a plurality of baseballs in a batting practice procedure. As such, the general purpose of the present invention, which will be described subsequently in greater detail, is to provide a new and improved batting trainer apparatus which has all the advantages of the prior art batting trainer apparatus and none of the disadvantages.

To attain this, the present invention provides a mounting plate including a plurality of support cylinders mounted orthogonally to the mounting plate, wherein each support cylinder is arranged to receive a baseball sphere at its upper end. Each cylinder is of a tubular construction to accommodate the baseball sphere and each cylinder including a coil spring mounted therewithin, with each coil spring including a plurality of spring rods fixedly mounted to adjacent coils of the spring. One of the spring rods is arranged for receiving a hook member, a lower distal end of the hook member secured to a suction cup. The suction cup is initially adhered to the mounting plate within the lower distal end of the cylinder, and each suction cup of each support cylinder arranged for randomly releasing the spring to project the spring upwardly to project the associated baseball sphere from the support cylinder with an axial of an individual attempting to strike the sphere. A modification of the invention includes the plate adjustably mounted relative to an underlying support in an angular orientation thereto, and further including an adjuster mechanism to alter adherence of each suction cup relative to the mounting plate.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure in based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved batting trainer apparatus which has all the advantages of the prior art batting trainer apparatus and none of the disadvantages.

It is another object of the present invention to provide a new and improved batting trainer apparatus which may be easily and efficiently manufactured and marketed.

It is a further object of the present invention to provide a new and improved batting trainer apparatus which is of a durable and reliable construction.

An even further object of the present invention is to provide a new and improved batting trainer apparatus which is susceptible of a low cost of manufacture with regard to both materials and labor, and which accordingly is then susceptible of low prices of sale to the consuming public, thereby making such batting trainer apparatus economically available to the buying public.

Still yet another object of the present invention is to provide a new and improved batting trainer apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
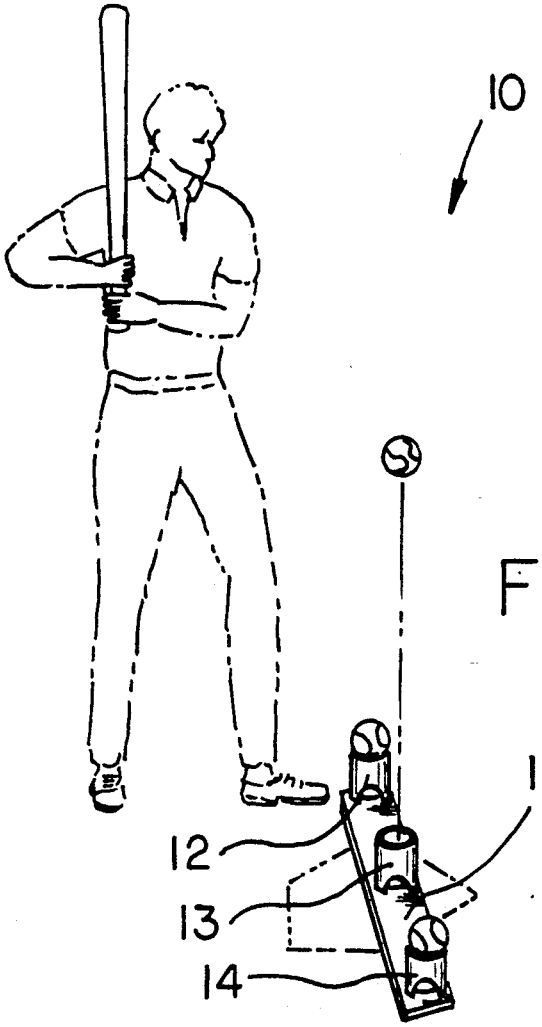
FIG. 1 is an isometric illustration of the instant invention.
Figure 2:
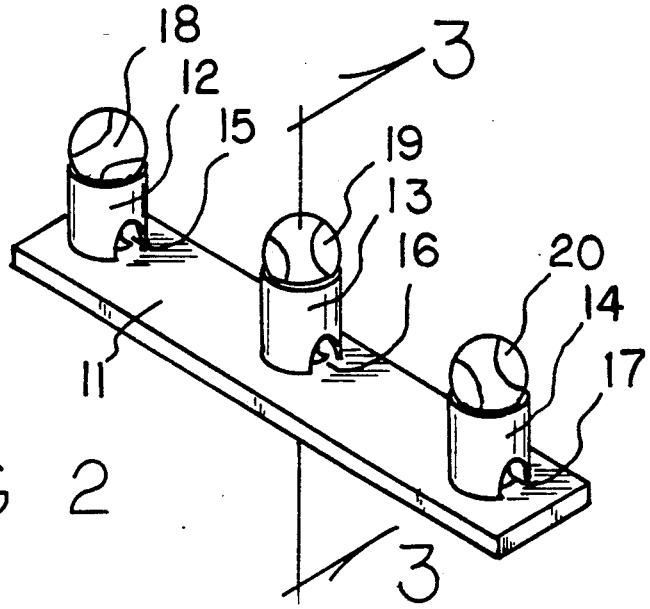
FIG. 2 is an isometric enlarged illustration of the instant invention.

With reference now to the drawings, and in particular to FIGS. 1 to 8 thereof, a new and improved batting trainer apparatus embodying the principles and concepts of the present invention and generally designated by the reference numerals 10 and 10*a* will be described.

Figure 3:
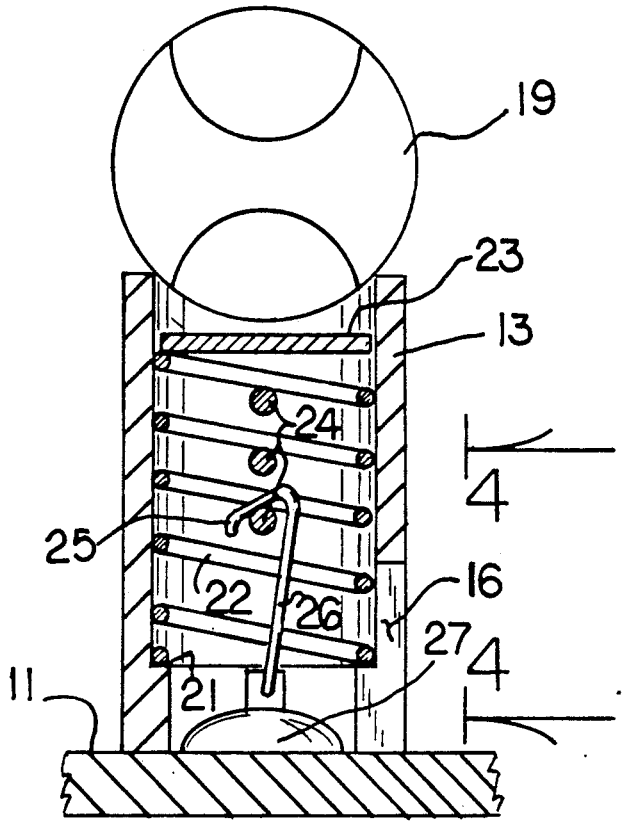
FIG. 3 is an orthographic view, taken along the lines 3—3 of FIG. 2 in the direction indicated by the arrows.
Figure 4:
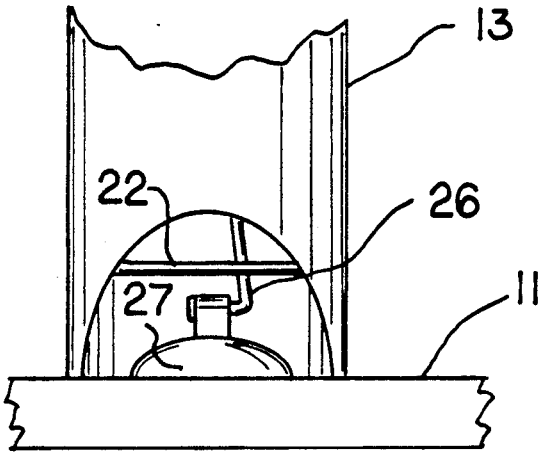
FIG. 4 is an orthographic view, taken along the lines 4—4 of FIG. 3 in the direction indicated by the arrows.

More specifically, the batting trainer apparatus 10 of the instant invention essentially comprises a mounting plate 11 including a planar top surface, with a respective first, second, and third support cylinder 12, 13, and 14 of tubular construction mounted orthogonally relative to the mounting plate top surface. A respective first, second, and third access opening 15, 16, and 17 are directed respectively through the respective first, second, and third support cylinders at intersections of the respective support cylinders 12, 13, and 14 with the mounting plate top surface for access interiorly of each support cylinder at each support cylinder's lower end portion for access to each respective suction cup for securement to the mounting plate top surface by a user. A respective first, second, and third baseball sphere 18, 19, and 20 is arranged for reception onto an upper end of each respective first, second, and third support cylinder below an associated support flange 23, such as illustrated in the FIG. 3. The FIG. 3 is illustrative of the second support cylinder 13, but it is understood that each of the support cylinders are of identically construction and for ease of illustration, the second support cylinder 13 will be discussed in detail where it is understood that such detail is applied all of the support cylinders. An annular support flange 21 is formed within each support cylinder interior surface adjacent the support cylinder's lower distal end. A cylindrical coil spring 22 is accordingly received upon the support flange 21, wherein the upper distal end of the spring 22 includes a support flange 23 mounted thereon. As illustrated in FIG. 3, the spring 22 is in a contracted orientation whereupon release of the spring effects projection upwardly of the support flange 23 to project the baseball sphere 19 therefrom for access to an associated batter, as illustrated in FIG. 1.

To achieve this purpose, a plurality of spaced parallel spring rods 24 are fixedly mounted to adjacent coils of the spring 22 in a parallel relationship relative to the mounting plate top surface. A hook member 25 is arranged for selective reception about one of the spring rods 24, with the hook member including a hook member rod 26 directed downwardly from the hook member and secured to a boss portion of a suction cup 27. The suction cup 27 is accordingly depressed against the mounting plate top surface, whereupon the suction cup randomly releases the mounting plate top surface permitting projection upwardly of the support flange and subsequent projection of the baseball sphere from the support cylinder. It should be understood that the plurality of spring rods 24 permits various tensioning of the spring 22 to permit various heights of trajectory of the baseball sphere when impacted by the support flange 23 upon release of the suction cup 27 relative to the mounting plate 11.

Figure 5:
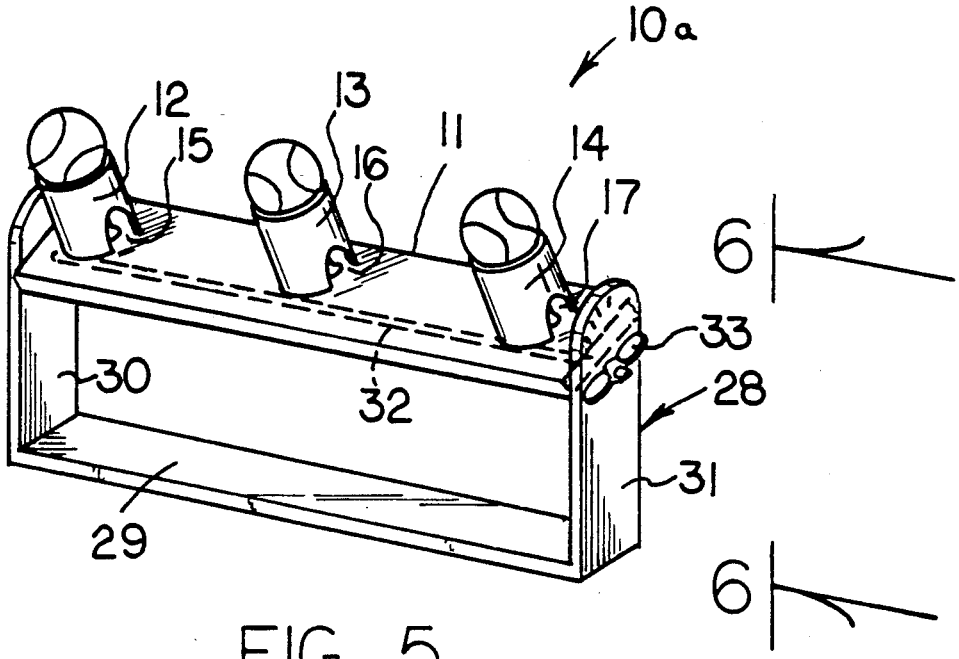
FIG. 5 is an isometric illustration of a modified aspect of the invention.
Figure 6:
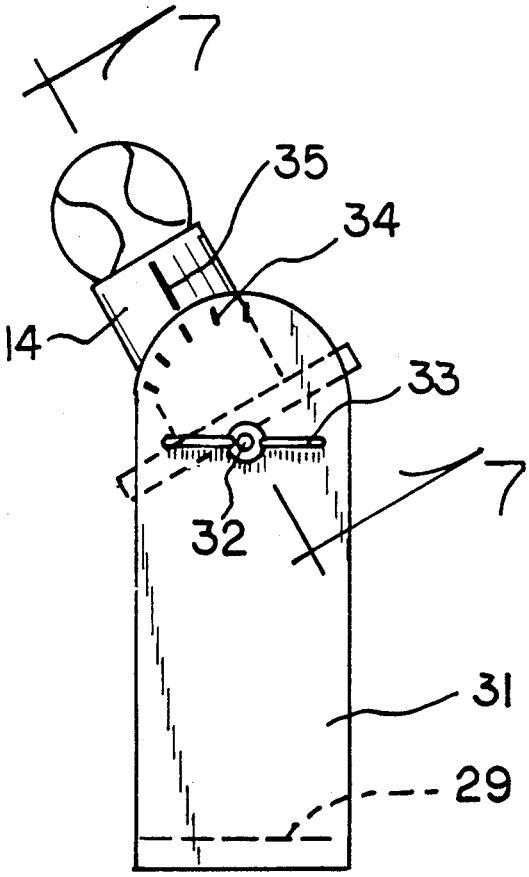
FIG. 6 is an orthographic view, taken along the lines 6—6 of FIG. 5 in the direction indicated by the arrows.

The FIG. 5 illustrates a modified apparatus 10*a*, wherein a mounting plate support 28 pivotally mounts the mounting plate 11. The mounting plate 28 includes a central web 29 integrally mounting a respective first and second plate 30 and 31 at each distal end of the central web 29 in an orthogonal relationship relative thereto. The first and second plates 30 and 31 are arranged in a parallel coextensive relationship relative to one another. A support rod 32 is orthogonally directed through the first and second plates 30 and 31 arranged in a parallel relationship relative to the central web 29 spaced thereabove. The support rod 32 is affixed medially and longitudinally of the mounting plate 11, with the support rod projecting through the second plate 31 permitting access and securement by a fastener 33 to permit pivotal orientation of the mounting plate 11 relative to the central web 29. A plurality of second plate indicia 34 are indicated in a semi-circular array 34 adjacent an upper distal end of the second plate 31 for cooperation with a third support cylinder indicia 35 that is oriented medially of the third cylinder and orthogonally oriented relative to the mounting plate top surface.

Figure 7:
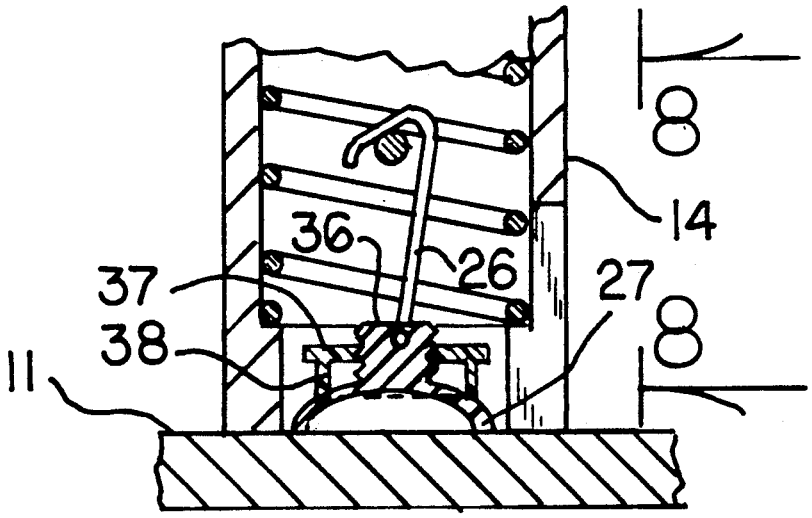
FIG. 7 is an orthographic view, taken along the lines 7—7 of FIG. 6 in the direction indicated by the arrows.
Figure 8:
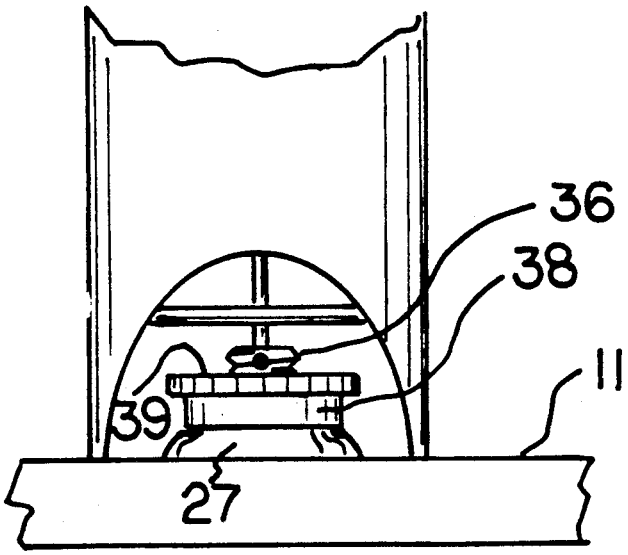
FIG. 8 is an orthographic view, taken along the lines 8—8 of FIG. 7 in the direction indicated by the arrows.

The FIGS. 7 and 8 illustrate the use of a suction cup adjuster structure that includes the suction cup boss formed as an externally threaded support boss 36, with an adjuster cup 37 threadedly secured about the threaded support boss 36. The adjuster cup 37 includes a cylindrical skirt 38 formed with an adjuster cup top wall 39 orthogonally mounted to an upper distal end of the cylindrical skirt 38. The adjuster cup top wall 39 is formed to include a medially oriented threaded bore to threadedly receive the threaded support boss 36. In this manner, rotation of the adjuster cup 37 about the threaded support boss 36 permits adjustable deflection and deformation of the suction cup 27 to alter its adhering ability to the mounting plate top surface and thereby permit release of the spring 22 at adjustable time intervals subsequent to securement of the suction cup 27 to the mounting plate top surface.

It should be further noted that the three support cylinders 12–14 are illustrated by way of example and their number may be varied according to needs and spacing relative to an associated individual.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A batting trainer apparatus, comprising, a mounting plate, the mounting plate including a planar top surface, and tubular support cylinders fixedly and orthogonally secured to the mounting plate planar top surface, and a baseball positioned on an upper distal end of each support cylinder in a first position, and ball propelling means secured within each support cylinder to project each baseball from each support cylinder randomly, and each support cylinder includes an access opening directed through each support cylinder adjacent an intersection of each support cylinder with the mounting plate top surface to permit a user to secure said ball propelling means to said mounting plate, said ball propelling means includes an annular coil spring mounted within each cylinder spaced above a lower distal end of each cylinder, said spring includes a support flange fixedly mounted to an upper distal end of each spring for effecting impact of the baseball to project the baseball from the first position to the second position, and said ball propelling means further includes a plurality of parallel spring rods, the spring rods are integrally mounted in a parallel relationship to adjacent coils of the spring, and a hook member, the hook member selectively secured to one of the spring rods, and the hook member includes a hook member rod directed downwardly relative to the hook member, and the hook member rod including a rod lower distal end, and a suction cup, the suction cup including a support boss, and the rod lower distal end directed through the support boss when the suction cup is positioned in adjacency to the mounting plate planar top surface and arranged for securement to the mounting plate planar top surface, whereupon subsequent release of the suction cup relative to the mounting plate planar top surface effects release of the coil spring.

2. An apparatus as set forth in claim 1 wherein the suction cup is positioned adjacent said access opening.

3. An apparatus as set forth in claim 2 wherein the boss is externally threaded, and an adjuster cup threadedly and adjustably secured relative to the boss, the adjuster cup including a cylindrical skirt in contiguous communication with the suction cup, and the adjuster cup further including a top wall, the top wall threadedly receiving the boss therethrough, whereupon longitudinal adjustment of the adjuster cup relative to the boss effects selective deflection of the suction cup for adjusting an adherence of the suction to the mounting plate planar top surface.

4. An apparatus as set forth in claim 3 including a mounting plate support, the mounting plate support including a central web, the central web including a web first end and a web second end, and a first plate integrally and orthogonally mounted to the web first end, and a second plate integrally and orthogonally mounted to the web second end, wherein the first plate and the second plate are arranged in a parallel coextensive relationship relative to one another, and a support rod orthogonally directed through the first plate and the second plate, and a fastener threadedly secured to the support rod exteriorly of the second plate to effect selective rotative adjustment of the support rod relative to the second plate, and the mounting plate fixedly mounted to the support rod between the first plate and the second plate.

5. An apparatus as set forth in claim 4 wherein the second plate includes second plate indicia arranged in a semi-circular array adjacent an upper distal end of the second plate, and one of said plurality of support cylinders adjacent the second plate includes a third support cylinder indicia medially of said one of said support cylinders, wherein the support cylinder indicia is orthogonally oriented relative to the mounting plate planar top surface.

* * * * *